US008257572B2

(12) United States Patent
Castro et al.

(10) Patent No.: US 8,257,572 B2
(45) Date of Patent: Sep. 4, 2012

(54) METHOD FOR ELECTROCHEMICAL PLATING AND MARKING OF METALS

(75) Inventors: Pablo Adrian Castro, Buenos Aires (AR); Federico Jose Williams, Buenos Aires (AR)

(73) Assignee: Tenaris Connections Limited, Kingstown (VC)

( * ) Notice: Subject to any disclaimer, the term of this patent is extended or adjusted under 35 U.S.C. 154(b) by 912 days.

(21) Appl. No.: 12/057,522

(22) Filed: Mar. 28, 2008

(65) Prior Publication Data

US 2009/0242410 A1 Oct. 1, 2009

(51) Int. Cl.
*C25D 5/02* (2006.01)

(52) U.S. Cl. ..... 205/118; 205/159; 205/206

(58) Field of Classification Search ..... 205/93, 205/118, 133, 207, 159, 206
See application file for complete search history.

(56) References Cited

U.S. PATENT DOCUMENTS

| | | | | | |
|---|---|---|---|---|---|
| 2,426,962 | A | * | 9/1947 | Witchger | 205/122 |
| 2,673,836 | A | | 3/1954 | Vonada | 204/28 |
| 2,727,842 | A | * | 12/1955 | Otto | 428/472.2 |
| 2,848,392 | A | * | 8/1958 | Ford et al. | 205/274 |
| 2,961,395 | A | | 11/1960 | Icxi | 204/224 |
| 3,378,411 | A | * | 4/1968 | Bergen | 148/276 |
| 3,634,147 | A | * | 1/1972 | Helwig et al. | 428/640 |
| 3,820,980 | A | * | 6/1974 | Hartline | 420/59 |
| 1,597,934 | A | | 7/1979 | Kadija | 204/224 |
| 4,408,215 | A | | 10/1983 | Kitchen | 346/165 |
| 4,518,467 | A | | 5/1985 | Mason et al. | 204/37.1 |
| 4,596,611 | A | * | 6/1986 | Dawes et al. | 148/217 |
| 4,879,457 | A | * | 11/1989 | Ludden | 235/487 |
| 5,207,882 | A | | 5/1993 | Baublys et al. | 204/212 |
| 5,246,786 | A | | 9/1993 | Usui | 428/621 |
| 5,527,445 | A | | 6/1996 | Palumbo et al. | 205/103 |
| 5,593,571 | A | * | 1/1997 | Heyse et al. | 208/134 |
| 6,929,865 | B2 | | 8/2005 | Myrick | 428/469 |
| 7,235,165 | B2 | | 6/2007 | Lacey | 205/117 |
| 7,588,674 | B2 | * | 9/2009 | Frodis et al. | 205/222 |
| 2003/0234181 | A1 | | 12/2003 | Palumbo et al. | 205/115 |
| 2005/0205425 | A1 | | 9/2005 | Palumbo | 205/104 |

FOREIGN PATENT DOCUMENTS

| | | |
|---|---|---|
| CN | 1987107893 | 6/1988 |
| CN | 1721579 | 1/2006 |
| DE | 1 027 482 | 4/1958 |
| EP | 1 460 152 A1 | 9/2004 |
| EP | 1 522 608 A2 | 4/2005 |

OTHER PUBLICATIONS

D. Vanek, "An Update on Brush Plating", Metal Finishing, (Jul. 2002), pp. 18-20.

(Continued)

*Primary Examiner* — Luan Van
(74) *Attorney, Agent, or Firm* — Fitzpatrick, Cella, Harper & Scinto

(57) ABSTRACT

A method for the electrochemical plating or marking of metals includes providing a metal surface, providing an electroplating solution at the metal surface, and electroplating the metal surface with the electroplating solution. A top layer of the metal surface comprises an oxide scale. The method can also include masking a portion of the metal surface with a masking material. The electroplating solution can be provided at the metal surface by an electroplating brush, the oxide scale of the metal surface can be comprised primarily of magnetite and hematite, and the material comprising the metal surface can be steel.

18 Claims, 8 Drawing Sheets

OTHER PUBLICATIONS

Wen-Hua, et al., "A Study on Friction and Wear Characteristics of Substitute Chromium Brush Plating Layers Under Lubrication", Wear, 167(1993), pp. 127-131.
B. Wu, et al., "Automatic Brush Plating: An Update on Brush Plating", Materials Letters 60 (2006), pp. 1673-1677.
Xian-Hua, et al., "The Tribological Performance of Ni/$MoS_2$ Composite Brush Plating Layer in Vacuum", Wear, 157 (1992) pp. 381-387.
Xu, et al., "The Wear Behavior of Brush-plated Ni-W-Co/SiC Composite Layer With Oil Lubrication", Surface Review and Letters, vol. 12 No. 4 (2005), pp. 573-578.
K. Murali, et al., "Brush Plated CdSe Films on High Temperature Substrates", Journal of Materials Science 39 (2004), pp. 4345-4347.
K. Murali, et al., "Properties of ZnSe Films Brush Plated on High Temperature Substrates", Materials Letters 59 (2005), pp. 2621-2624.
K. Murali, et al., "Structural and Optical Properties of CdSe Films Brush Plated on Low Temperature Substrates", Materials Chemistry and Physics 96 (2006), pp. 103-106.
Norris, "Brush Plating", Sifco Selective Plating, (1995), pp. 349-361.
B. Subramanian, et al., Brush Plating of Tin(II) Selenide Thin Films, Journal of Crystal Growth 234 (2002), pp. 421-426.
B. Subramanian, et al., "Photoelectrochemical Characteristics of Brush Plated Tin Sulfide Thin Films", Solar Energy Materials & Solar Cells 79 (2003), pp. 57-65.
W. Tu, et al., "Electrocatalytic Action of Nano-$SiO_2$ with Electrodeposited Nickel Matrix", Materials Letters 60 (2006), pp. 1247-1250.
H. Wen-Hua, et al., "A Study on Friction and Wear Characteristics of Substitute Chromium Brush Plating Layers Under Lubrication", Wear, 167 (1993), pp. 127-131.
W.-H. Hui, et al., "A Study of the Corrosion Resistance of Brush-Plated Ni-Fe-W-P Films", Surface and Coatings Technology, 68/69 (1994), pp. 546-551.
W.-H. Hui, et al., "Microstructure and Hardness of Brush Plated Ni-Fe-W-P-S Alloy", Journal of Applied Electrochemistry 27 (1997), Technical Note, pp. 105-108.
L. Jia-Jun, et al., "A Study of the Wear Resistance and Microstructure of Pb-Sn and Pb-Sn-Ni Brush-Plating Layers", Wear, 155 (1992), pp. 63-72.
Y.-S. Ma, et al., "The Wear Resistance of an Ni-Cu-P. Brush Plating Layer on Different Substrates", Wear, 165 (1993), pp. 63-68.
S. Mohan, et al ., "Brush Plating—Present State of Art", Bulletin of Electrochemistry, 14(12), Dec. 1998, pp. 472-475.
K. Murali, "Structural, Optical and Photoelectrochemical Properties of Brush Plated $CdSe_xTe_{1-x}$ Thin Films", Journal of Materials Science, 38 (2003), pp. 3845-3849.
K. Baldwin, et al., "Repair of Metal Coatings Using Environmentally Compliant Brush-plating Solutions", Plating & Surface Finishing, (Jul. 1997), pp. 23-28.
X. Bin-shi, et al., "Fretting Wear-resistance of Ni-base Electro-brush Plating Coating Reinforced by Nano-alumina Grains", Materials Letters 60 (2006), pp. 710-713.
J. Dennis, et al., "Brush Plating", Surface Technology, 12 (1981), pp. 57-73.
J. Dini, "Brush Plating: Recent Property Data", Metal Finishing, (Jun. 1997), pp. 88-93.
L. Du, et al., "Study of Tribological Characteristics and Wear Mechanism of Nano-particle Strengthened Nickel-based Composite Coatings Under Abrasive Contaminant Lubrication", Wear, 257 (2004), pp. 1058-1063.
L. Du, et al., "Preparation, Microstructure and Tribological Properties of Nano-$AI_2O_3$/Ni Brush Plated Composite Coatings", Surface & Coatings Technology 192 (2005), pp. 311-316.
S. Hu, et al., "Adhesion Strength and High Temperature Wear Behaviour of Ion Plating TiN Composite Coating with Electric Brush Plating Ni-W Interlayer", Surface and Coatings Technology 141 (2001) pp. 174-181.
International Search Report dated Sep. 30, 2009, in related corresponding PCT Application No. PCT/EP2009/053674 as mailed on Sep. 30, 2009; and Written Opinion of the International Searching Authority.

* cited by examiner

METHOD FOR ELECTROCHEMICAL PLATING AND MARKING OF METALS

BACKGROUND OF THE INVENTION

1. Field of the Invention

This invention generally relates to the marking of metals with a plating formed from an electroplating solution. In particular, the invention relates to the local plating of metals onto an oxide scale.

2. Description of the Related Art

Electroplating is a known technique for the plating of conducting surfaces. In general terms, electroplating refers to the technique of depositing a metal layer onto a cathode through the use of a metal ion current. The ion current is established in response to a voltage generated between the cathode and an anode by an external power source. In some instances, the anode is at least partially comprised of solid metal atoms, which are oxidized by a potential difference and dissolve into an intermediate electrolytic solution. In other instances, metal ions are introduced directly into the electrolytic solution through, for example, the dissolution of metal salts into the solution. In either instance, the electric field between the cathode and anode causes the metal ions travel through the solution to the cathode, where the ions are electrically reduced and thus deposited onto the cathode surface as a solute of metal atoms.

Electroplating commonly is performed by placing the object to be electroplated, i.e., the cathode, in an electrolyte bath also containing the anode. For example, U.S. Pat. No. 5,246,786 discloses electroplating a SPCC-grade steel tube with a nickel plating. The electrolyte used by the '786 patent is a Watts-type bath. A Watts-type bath is a known electrolytic solution for plating nickel and is comprised of nickel sulfate, nickel chloride and boric acid in varying proportions, depending upon the physical properties desired of the nickel plate, e.g., conductivity and luster. In the '786 patent, prior to nickel plating, the steel tube is coated with 3 μm of copper.

One drawback of the bath electroplating method is that the entire surface of the object is plated. An electroplating method that overcomes this limitation and allows for the plating of localized areas of an object is brush plating. In the brush plating method, the anode partially comprised of an absorbent material, which contains the electrolytic solution and prevents a short circuit from occurring due to contact between the cathode and the anode. Electroplating is then performed by brushing the anode over the cathode. In this manner, a localized area of a larger surface may be electroplated. One example of brush electroplating is described by U.S. patent application Ser. No. 10/278,889, which discloses brush plating steel tubes with a nickel electrolyte for the purposes of in situ crack repair. In the '889 application, plating thicknesses of approximately 25 mm are achievable using a Watts-type bath, and the nickel plating is comprised of nanocrystalline nickel grains having a average grain size of 13 nm. Steels suitable for use in the process described by the '889 application include 4130 high-carbon, 304 stainless and 1018 low-carbon steels. U.S. patent application Ser. No. 10/516,300 discloses a process similar to that of the '889 application. In the '300 application, a graphite anode is used to brush plate nickel onto various metals; a Watts-type electrolyte is used, with nickel carbonate added at periodic intervals to maintain a desired concentration of nickel ions.

When performing an electroplating procedure such as those described above, however, certain limitations must be considered because electroplating cannot be carried out on an oxide layer. In an electroplating process, an electrically-conductive cathode is typically required; otherwise, the cathode can act as a capacitive element in the electrical circuit, preventing the flow of the metal ion current and effectively halting the electrochemical process. Thus, capacitive surface layers—in particular, oxide layers, as well as greases, oils, and dirt—generally must be removed from the cathode prior to plating. In many instances, these surface layers should also be removed to facilitate adhesion of the plating to the cathode. For example, the '889 application describes the use of alkaline cleaners to remove dirt, oil, and grease from the cathode, followed by the use of an activation solution to remove any surface oxides. The electroplating apparatus used to perform the process disclosed by the '889 application includes pathways for the flow of these surface cleaning and activation fluids.

As another example, the '786 patent uses an intermediary layer of copper coating onto which nickel is plated. Therefore, in the '786 patent there is no need to activate the surface in the manner described by the '889 application. However, although the '786 patent may describe electroplating onto steel without removal of the native oxide, the workaround proposed is unwieldy; deposition or formation of a copper coating prior to electroplating can increase the cost, time, and labor required to electroplate the steel. Depending upon the size of, placement of, or environmental conditions around the steel part, deposition of a conductive layer prior to electroplating may even be impossible.

SUMMARY OF THE INVENTION

The present invention addresses the challenges in the art discussed above.

According to an example aspect of the invention, a method for electroplating is provided. The method includes providing a metal surface, providing an electroplating solution at the metal surface, and electroplating the metal surface with the electroplating solution, wherein a top layer of the metal surface comprises an oxide scale.

Further features and advantages, as well as the structure and operation, of various example embodiments of the present invention are described in detail below with reference to the accompanying drawings.

BRIEF DESCRIPTION OF THE DRAWINGS

The features and advantages of the example embodiments of the invention presented herein will become more apparent from the detailed description set forth below when taken in conjunction with the drawings. Like reference numbers between two or more drawings indicate identical or functionally similar elements.

DETAILED DESCRIPTION OF THE EXAMPLE EMBODIMENTS

As described above, oxide surface layers such as oxide scale generally prevent a metal (e.g., steel) surface from being used as a cathode in an electrochemical deposition, unless the oxide scale is removed or a conductive layer is deposited onto the metal surface. Thus, an advantage of the present invention is the avoidance of the added cost, time, and complexity associated with scale removal and/or the deposition of additional layers prior to the electroplating of the metal surface.

Some metals (such as steels, which are primarily comprised of iron) typically have a surface layer of oxide, which may be referred to as a native oxide. These surface layers can form in the presence of ambient oxygen; in particular, surface oxide layers can form on steel during the metal-working or metal-forming process. One procedure for forming steel is hot rolling, whereby steel is heated above its recrystallization temperature and then passed through rollers. The rollers deform the heated steel, serving a dual purpose: eliminating structural defects and obtaining a desired shape. A side effect of hot rolling is the formation of surface oxide, which is generally thick because of the high surface temperature of the steel during hot rolling. This thick surface oxide is generally referred to in the art as "scale" or "scaling." The physical, chemical and other properties of a scale can be enhanced, altered, or otherwise modified through further treatment of the steel. Such treatments can include, for example, reheating and other heat treatments.

During a reheating treatment of certain steels, the iron oxide scales which form can be comprised of wustite (FeO), magnetite ($Fe_3O_4$), and hematite ($\alpha$-$Fe_2O_3$), as described below in connection with FIG. 2. However, wustite, which only forms at temperatures exceeding 570° C., decomposes into magnetite and iron at temperatures below 570° C. Thus, below this temperature (e.g., following a reheating treatment), the oxide scale can be primarily comprised of magnetite, with a thin upper layer of hematite. Furthermore, if the rolling conditions are highly oxidant, then wustite may not be stable even at temperatures exceeding 570° C.

Magnetite exhibits electrical conductivity greater than other iron oxides. In fact, magnetite generally has a conductivity of 100-1000 ohm-cm. This high conductivity is a result of magnetite's spinel crystal structure: the octahedral $Fe^{2+}$ and $Fe^{3+}$ cations are spatially close, and therefore electron holes can migrate easily between cations. As discussed below in connection with FIGS. 1 and 2, an oxide scale resulting from the hot rolling of steel can be predominantly comprised of magnetite. Thus, according to an aspect of the present invention, a hot rolled steel can have a conducting oxide scale suitable for performing electroplating without prior treatments such as oxide removal or additional layer depositions.

Figure 1:
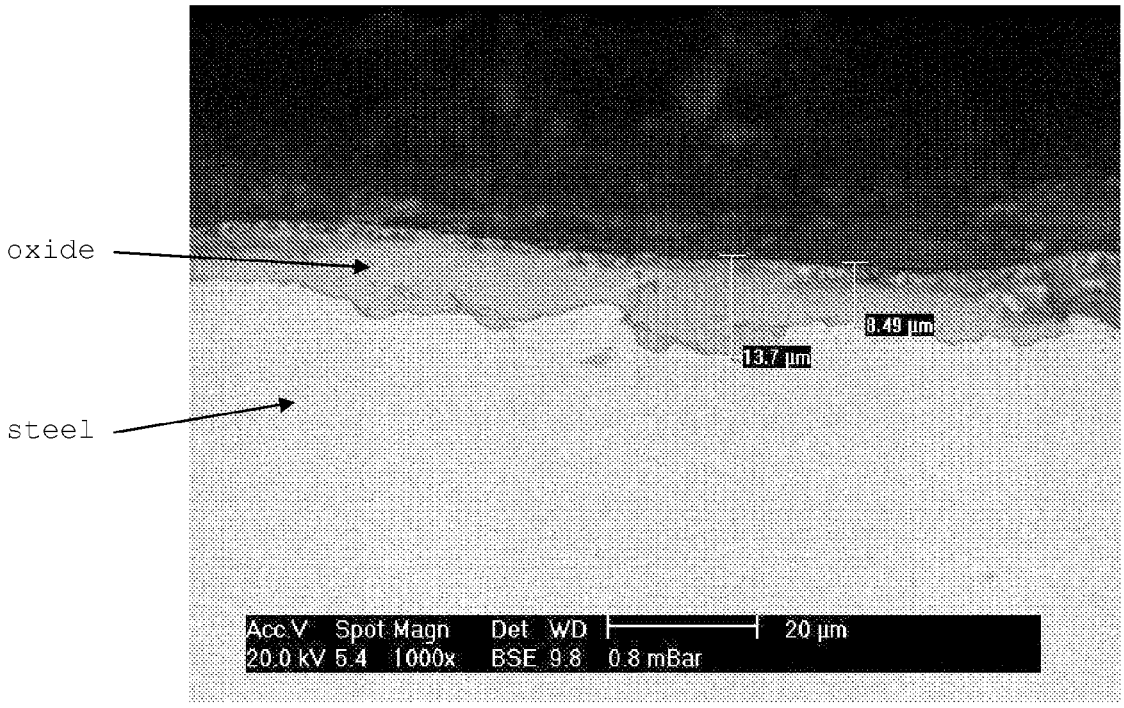
FIG. 1 is an SEM micrograph at a 1000× magnification showing a cross-sectional microstructure of an example steel surface having an oxide scale.

FIG. 1 shows a scanning electron micrograph of an example steel surface subsequent to hot rolling. Visible in the micrograph are both steel, shown in light gray, and an oxide scale, shown in dark gray. Prior to the capture of the image shown in FIG. 1, the steel underwent hot rolling, reheating, and heat treatments; thus, because the hot rolling of steel typically results in an oxide scale, the surface of the steel is covered with an oxide scale. The oxide scale varies in thickness from 8.49 μm to 13.7 μm.

According to an example aspect of the invention, a representative, common TN95SS steel tube is shown in FIG. 1 to be suitable for use with one or more of the electroplating methods provided herein. The steel used can be a carbon steel, an alloyed steel, or the like. In an example embodiment of the invention, the surface weight percentage ranges of the elements chemically composing the steel are as follows:

| | |
|---|---|
| carbon: | 0.26-0.32 |
| manganese: | 0.41-1.04 |
| sulfur: | 0.003-0.004 |
| phosphorus: | 0.008-0.011 |
| silicon: | 0.19-0.38 |
| nickel: | 0.46-0.08 |
| chromium: | 0.19-1.11 |
| molybdenum: | 0.02-0.79 |
| vanadium: | 0.002-0.004 |
| copper: | 0.06-0.11 |
| tin: | 0.004-0.009 |
| aluminum: | 0.006-0.042 |
| titanium: | 0.003-0.012. |

Additionally, the chemical composition of a preferred steel may include an amount of calcium ranging from of 20-22 ppm. Steels generally suitable for use in such embodiments include steels defined in the API 5CT/ISO 11960 standard such as, for example, L80SS, T95SS, and J55. In these example embodiments, the steel surfaces can be processed by hot rolling. As described above, following processing, the surfaces can have oxide scales with high levels of magnetite, as discussed below in connection with FIG. 2.

According to another aspect of the invention, however, the electroplated metal need not be a steel. Those having skill in the relevant arts will recognize that an oxide scale suitable for electroplating, e.g., an oxide comprised primarily of magnetite, can form on metals other than steel. An example of a non-steel metal suitable for use with the electroplating methods described herein is pure iron. Further examples and descriptions of suitable steel and non-steel metals which may be suitable for practicing example embodiments of the invention can be found in a book authored by Meier et al. entitled "Introduction to the High-Temperature Oxidation of Metals" (2006).

Figure 2:
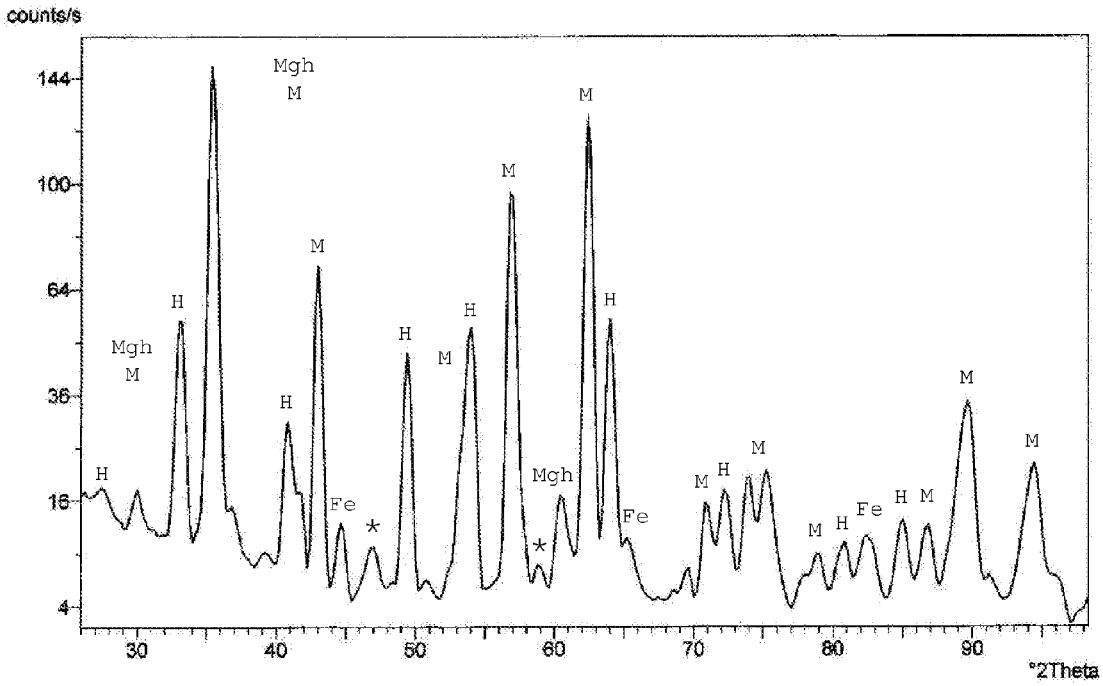
FIG. 2 is an XRD diffractogram showing the relative intensities of various chemical components of an example steel surface having oxide scale, which may be suitable for practicing one or more embodiments of the invention.

FIG. 2 is an x-ray diffractometer (XRD) diffractogram of a steel processed in a similar manner to the steel shown in FIG. 1. The diffractogram shows relative x-ray intensities due to various compounds comprising the steel, including magnetite, hematite, maghemite (another form of iron oxide), and iron, labeled in the figure as "M," "H," "Mgh," and "Fe," respectively. Asterisked peaks indicate the possibility of trace amounts of iron oxide carbonate. The presence of several strong magnetite peaks indicates the prevalence of magnetite in the oxide scale. Hematite peaks are observable with less intensity, and maghemite peaks are the least intense iron oxide peaks. The diffractogram of FIG. 2 indicates that the magnetite is the predominant iron oxide form present in the oxide scale of the steel.

Figure 3:
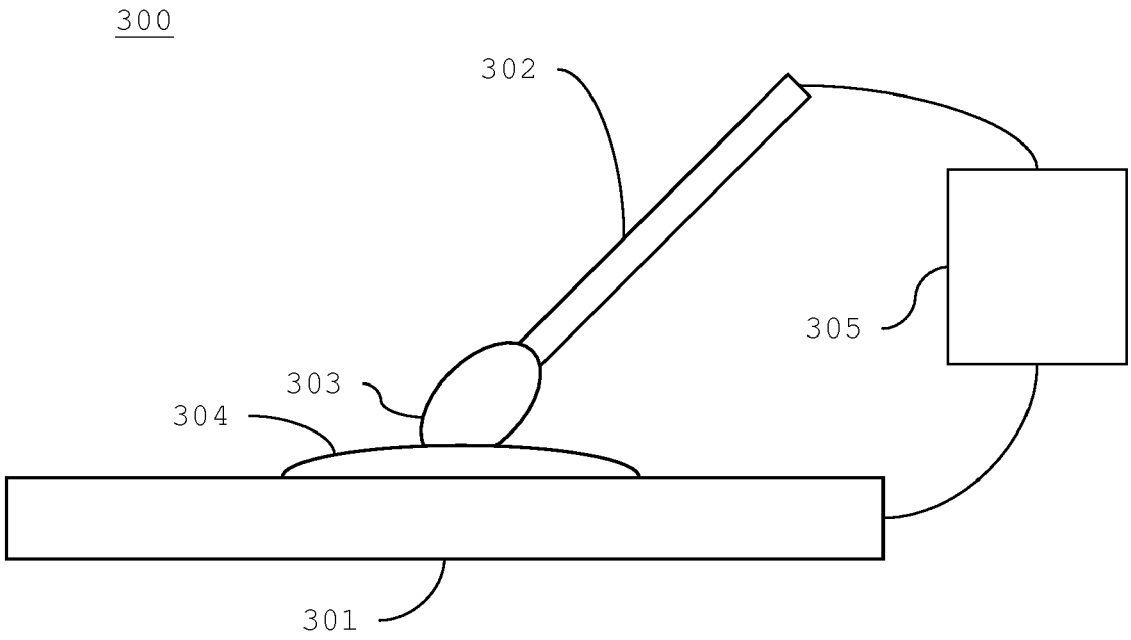
FIG. 3 illustrates an example brush electroplating apparatus, which can be used in accordance with embodiments of the invention.

FIG. 3 illustrates an electrochemical deposition apparatus 300, which may be used in accordance with various embodiments of the invention. The deposition apparatus 300 may be used for brush plating applications. Deposition apparatus 300 is comprised of anode 302, absorber 303, and power supply 305. Anode 302 may be comprised of graphite or any suitable conducting material. Absorber 303 covers at least an end of anode 302; together, anode 302 and absorber 303 can form a brush with which a brush plating method may be performed. Absorber 303 may be felt, cotton gauze, or any other suitable insulating, absorbent material. Anode 302 is electrically coupled to power supply 305. Power supply 305 is capable of at least supplying DC power, and may also supply AC power of any waveform. Power supply 305 may further be capable of providing DC power of any duty cycle.

In the operation of deposition apparatus 300, power supply 305 is further electrically coupled to cathode 301. Cathode 301 is any part with a surface desired to be electroplated. According to an aspect of the invention, cathode 301 is any steel (or non-steel metal) having a suitable oxide scale, as discussed above in connection with FIGS. 1 and 2. Cathode 301 can be prepared for electroplating by, for example, wiping with acetone, water, or any other suitable solvent or cleaner. In order to electroplate cathode 301, the brush comprised of anode 302 and absorber 303 is dipped into or otherwise provided with electroplating solution 304. Electroplating solution 304 is partially comprised of the metal ions desired to be deposited onto cathode 301. The electroplating solution 304 is then brought into contact with cathode 301. Thus, as long as the surface of cathode 301 is conducting, there is an electrical circuit formed by the elements of deposition apparatus 300. The voltage provided by power supply 305 then creates an electric field between cathode 301 and anode 302, which causes the metal ions comprising electroplating solution 304 to travel through the solution to cathode 301, electrically reduce, and be deposited onto the surface of cathode 301.

Electroplating solution 304 can be any electroplating suitable for use with the above-described apparatus; example electroplating solutions, which will be familiar to those skilled in the relevant arts, include nickel Watts-type solutions, nickel chloride solutions, nickel-tungsten solutions, and acid copper plating solutions. In an example embodiment of invention, the electroplating solution is a Watts-type solution having the following concentration ranges:

| | |
|---|---|
| NiSO4: | 330-480 g/L |
| NiCl2: | 45-80 g/L |
| boric acid: | 35-60 g/L |
| lauryl sulfate: | 0.2-0.5 g/L. |

Figure 4:
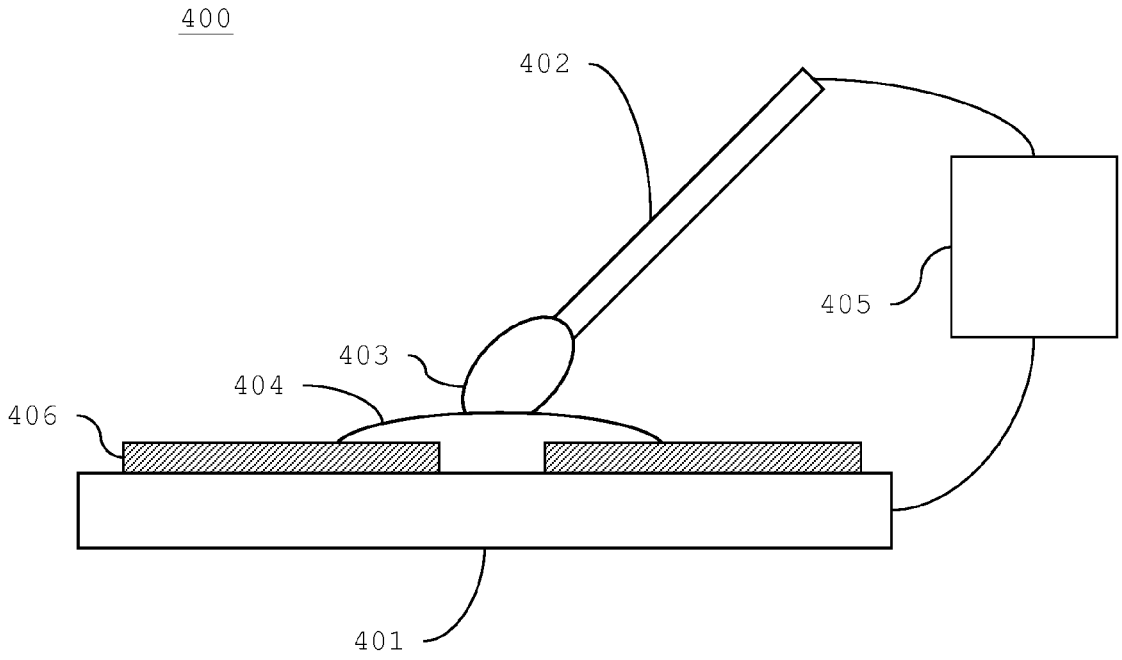
FIG. 4 illustrates another brush electroplating apparatus, which can be used in accordance with other embodiments of the invention

FIG. 4 illustrates another electrochemical deposition apparatus 400, which may be used in accordance with various embodiments of the invention. Like apparatus 300, apparatus 400 can be used for brush plating applications. Deposition apparatus 400 can be comprised of the same elements as apparatus 300; corresponding elements have similar reference numerals. Deposition apparatus 400 also includes a mask 406. Mask 406 (which, in the cross-sectional illustration of FIG. 4, is represented by both crosshatched areas) can be an insulating material such as, for example, an adhesive tape masking. Mask 406 can be placed on, attached to, or otherwise affixed to cathode 401 through the use of any suitable deposition or transfer system. In the example of mask 406 being comprised of an adhesive tape, the mask can be affixed to cathode 401 through the use of any manual or automatic process, including human placement of the tape or a thermal mask transfer system.

An example operation of deposition apparatus 400 proceeds in a manner similar to deposition apparatus 300. Due to mask 406, however, apparatus 400 does not electrochemically plate all surfaces in contact with electroplating solution 404. Rather, plating only occurs in areas where mask 406 is not present or affixed (as illustrated by the area between the crosshatched areas of mask 406). As a result, the cathode can be electroplated with predetermined or selective plating patterns and/or markings. Example patterns or markings include alphanumeric characters and bar codes.

In various example embodiments of the invention, electroplating as described herein (e.g., through the above-described operation of deposition apparatuses 300 or 400) can occur at various temperatures. A temperature of a steel surface onto which electroplating may be performed is preferably between ambient temperature and 90° C., although electroplating outside below ambient temperature or above 90° C. is both contemplated and possible. 50-60° C. is a more preferred range for the temperature of a steel surface during electroplating. Therefore, for a steel hot-rolled prior to deposition, it may be preferable to electroplate such steel following hot rolling, i.e., while the steel surface retains a temperature above ambient.

Moreover, exposure to various environmental conditions can affect the suitability of a steel surface for electroplating. Prolonged exposure to moisture (e.g., humidity) and/or temperature (e.g., sunlight) can cause iron oxide to convert from magnetite to maghemite. Prolonged exposure to corrosive materials can produce non-adherent, non-conductive byproducts. Both of these results can deleteriously affect a later electroplating process. Therefore, it may be preferable to avoid exposure of a steel surface to harsh environmental conditions prior to electroplating, e.g., the steel can be stored indoors prior to electroplating.

Figure 5:
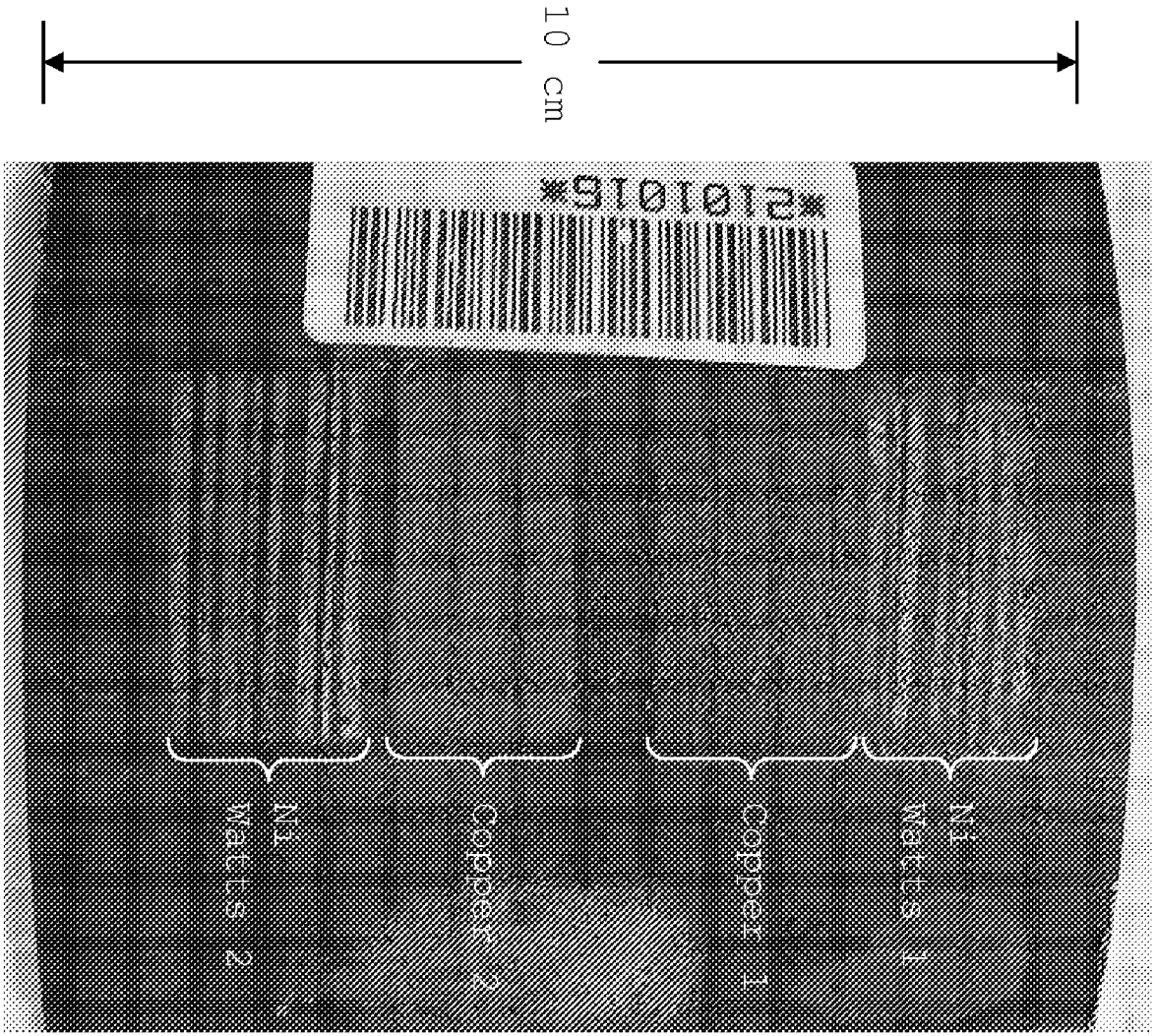
FIG. 5 shows a steel surface patterned according to an embodiment of the invention.

FIG. 5 shows an image of example bar codes patterned onto a steel surface. The bar codes are electroplated onto a sample steel tube. Each bar code is labeled, with the label corresponding to a specific electroplating solution used in plating the bar code pattern. The bar code labeled "Ni Watts 1" was plated using a nickel Watts-type solution (as described above in connection with FIG. 3) heated to 65° C. The electroplating voltage was 6.5 V. The bar code labeled "Copper 1" was plated using an acid copper solution (248 g/L of $CuSO_4$ and 11 g/L of 98% sulfuric acid) at ambient temperature. The electroplating voltage was 7.5 V. The bar code labeled "Copper 2" was plated using another acid copper solution (248 g/L of $CuSO_4$, 11 g/L of 98% sulfuric acid, and 120 ppm of HCl) heated to 50° C. The electroplating voltage was 7.5 V. The bar code labeled "Ni Watts 2" was plated using a nickel Watts-type solution heated to 55° C. The electroplating voltage was 7.5 V. Each bar code shown in FIG. 5 was electroplated for one minute. The length bar labeled "10 cm" is provided to show the size of the bar codes.

Figure 6A:
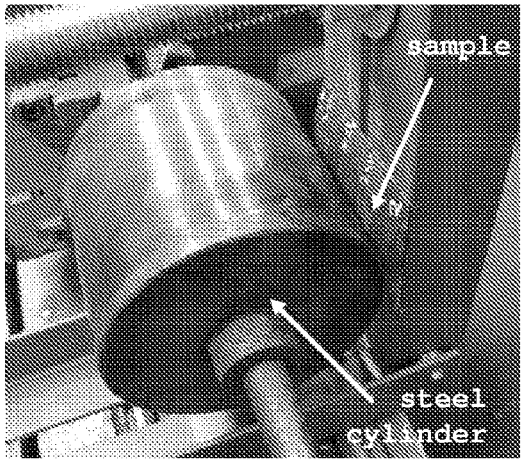
FIGS. 6A-C show an example abrasion test system and various results of abrasion tests performed by the system.
Figure 6B:
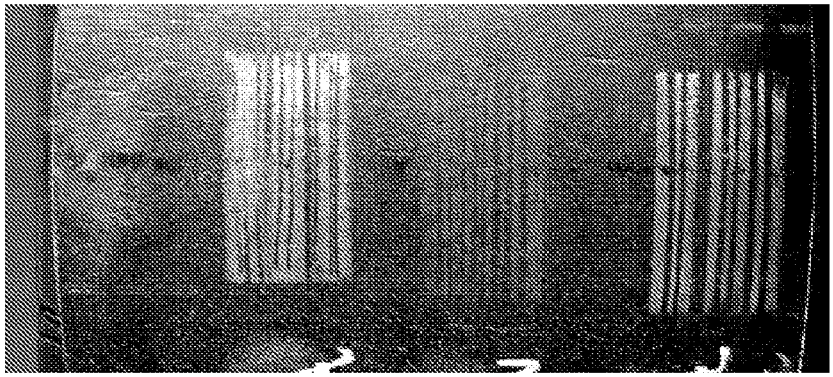
Figure 6C:
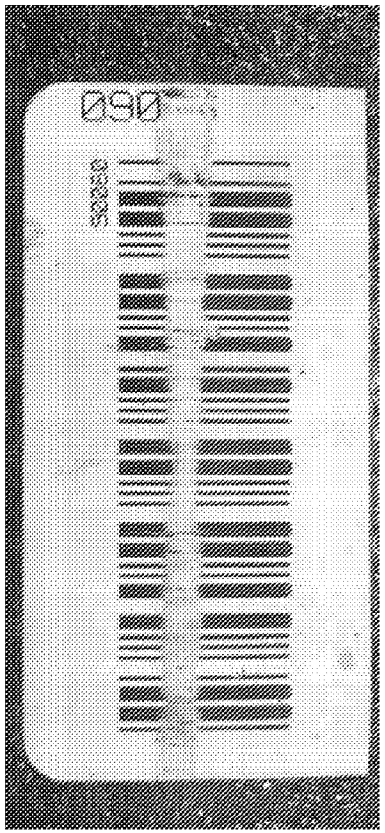

As shown in FIG. 5, a steel surface having a top layer comprised of an oxide scale can be successfully electroplated with various metals (including copper and nickel). Furthermore, the electroplated metal exhibits wear characteristics suitable for use in high-wear or high-abrasion applications, as demonstrated by FIGS. 6A-C. FIG. 6A is an image of an abrasion test system comprised of a steel cylinder configured to roll over a sample (e.g., one of the electroplated patterns shown in FIG. 5). FIG. 6B is an image of several electroplated nickel bar codes (on an oxide scale) following an abrasion test comprised of 500 turns of the steel cylinder of FIG. 6A; FIG. 6C is an image of a standard adhesive paper label bar code (e.g., a bar code ordinarily used for labeling or tracking) after 50 turns of the cylinder. Comparison of FIGS. 6B and 6C demonstrates that the electroplated nickel is far more wear-resistant than a standard adhesive paper bar code.

Figure 7:
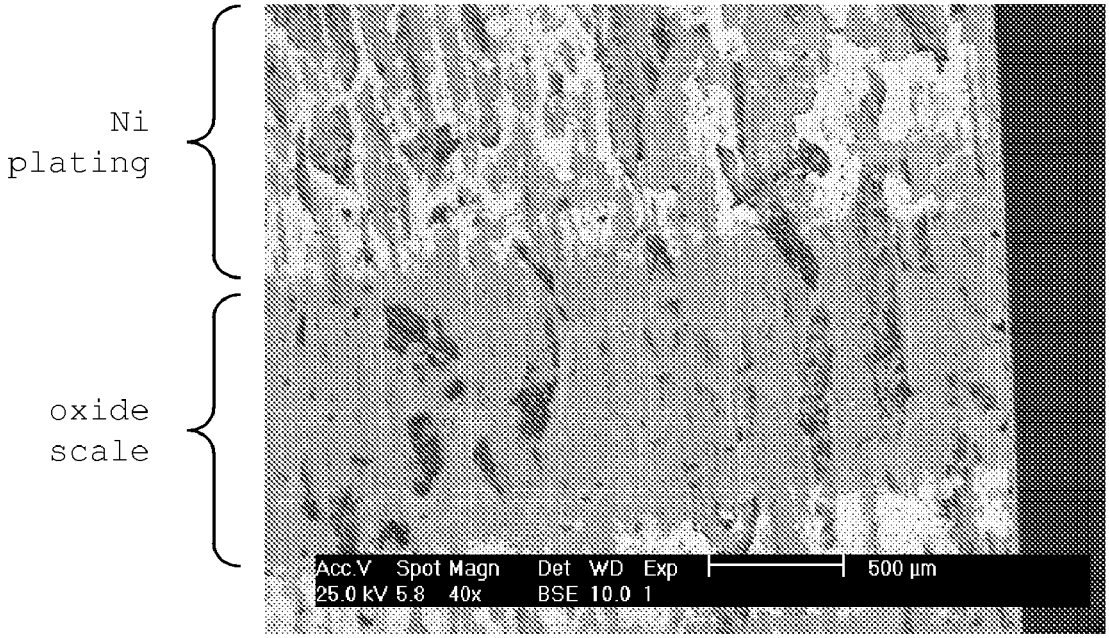
FIG. 7 is an SEM micrograph at a 40× magnification showing a nickel plating on an example steel surface having an oxide scale.

FIG. 7 shows a scanning electron micrograph of an example steel surface having an oxide scale subsequent to a nickel plating. The plating was performed by a selective brush plating procedure, as described above, resulting in a barcode pattern. Visible in the micrograph is a horizontal band of nickel plating, shown in light gray, above a horizontal band the oxide scale, shown in dark gray. Below the band of oxide scale is a smaller band of nickel plating, which is mostly obscured by the micrograph legend.

Figure 8A:
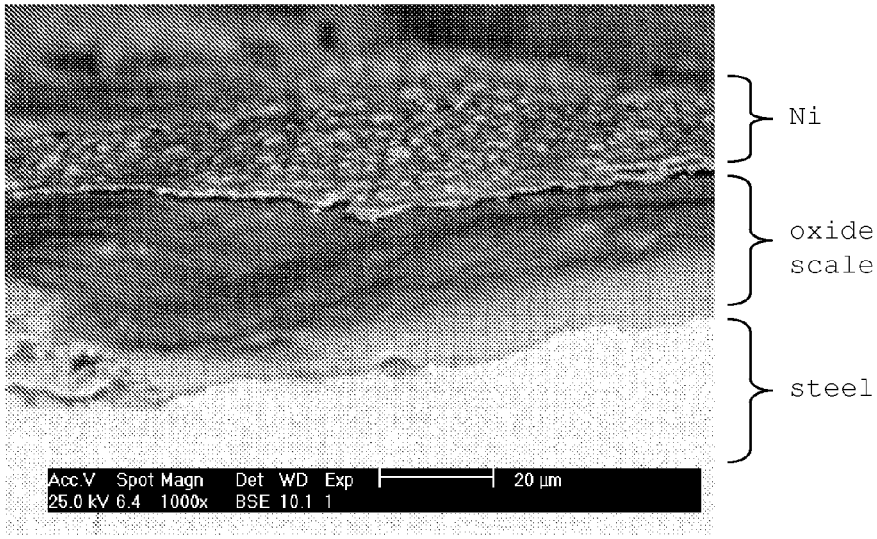
FIGS. 8A and 8B are SEM micrographs at various magnifications showing a cross-sectional microstructure of a nickel plating on an example steel surface having an oxide scale.
Figure 8B:
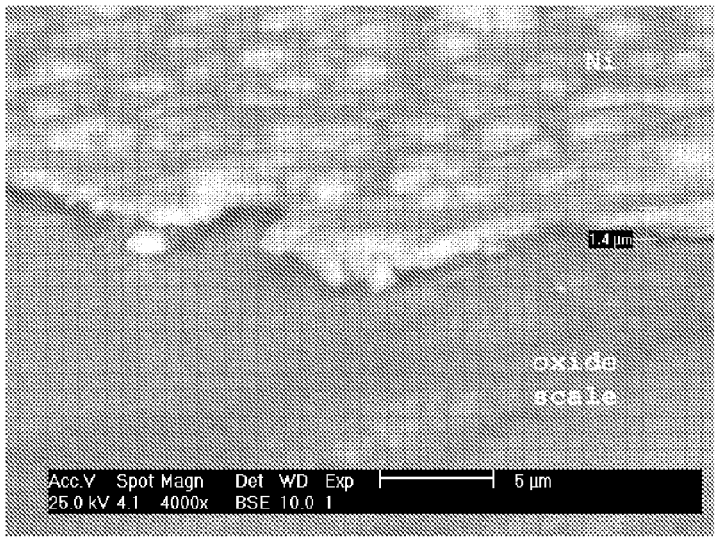

FIGS. 8A and 8B show a cross-sectional microstructure of the steel surface of FIG. 7. FIG. 8A, taken at a 1000× magnification, shows a thin, distinct layer of nickel, which plates the thick iron oxide scale. Several μm beneath the plating is a visible transition from oxide scale to steel. FIG. 8B shows the nickel-oxide boundary at a 4000× magnification. As measured by the electron microscope, a thickness of the nickel plating is approximately 1.4 μm. The plating appears highly conformal to the oxide scale.

By virtue of the example embodiments described herein, a metal surface having an oxide scale can be electrochemically plated. Because the oxide scale can be comprised primarily of magnetite, which can be a conducting form of iron oxide, the oxide scale can be suitable for use as a cathode in an electrochemical plating procedure. Additionally, by providing a mask on the oxide scale prior to electroplating, the metal surface can be selectively plated with a predetermined pattern.

In the foregoing description, example aspects of the present invention are described with reference to specific example embodiments. Despite these specific embodiments, many additional modifications and variations would be apparent to those skilled in the art. Thus, it is to be understood that example embodiments of the invention may be practiced in a manner otherwise than as specifically described. For example, although one or more example embodiments of the invention may have been described in the context of an oxide scale comprised mainly of magnetite, in practice the example embodiments may include an oxide scale comprised of any conducting oxide. Accordingly, the specification is to be regarded in an illustrative rather than restrictive fashion. It will be evident that modifications and changes may be made thereto without departing from the broader spirit and scope.

Similarly, it should be understood that the figures are presented solely for example purposes. The architecture of the example embodiments presented herein is sufficiently flexible and configurable such that it may be practiced (and navigated) in ways other than that shown in the accompanying figures.

Furthermore, the purpose of the foregoing abstract is to enable the U.S. Patent and Trademark Office, the general public, and scientists, engineers, and practitioners in the art who are unfamiliar with patent or legal terms or phrases, to quickly determine from a cursory inspection the nature and essence of the technical disclosure of the application. The abstract is not intended to limit the scope of the present invention in any way. It is also to be understood that the processes recited in the claims need not be performed in the order presented.

What is claimed is:

1. A method for electroplating, the method comprising:
providing a metal substrate, the metal substrate having a surface layer comprising an oxide scale;
providing an electroplating solution at the metal substrate; and
electroplating the surface layer with the electroplating solution;
wherein the metal substrate consists of one of iron and steel,
wherein the oxide scale is formed prior to the step of providing the electroplating solution,
wherein the oxide scale is formed by thermal oxidation of the metal substrate,
wherein the oxide scale includes magnetite, and
wherein a thickness of the oxide scale varies from 8.49 μm to 13.7 μm.

2. The method of claim 1, further comprising:
masking a portion of the metal substrate with a masking material.

3. The method of claim 2, wherein the masking material masks the portion of the metal substrate in a predetermined pattern.

4. The method of claim 3, wherein the predetermined pattern is a bar code.

5. The method of claim 4, wherein the masking material is applied to the metal substrate by a thermal mask transfer system.

6. The method of claim 5, wherein the masking material is an adhesive tape.

7. The method of claim 1, wherein the electroplating solution is provided at the metal substrate by an electroplating brush.

8. The method of claim 7, wherein the electroplating solution is a Watts-type solution that comprises:
NiSO4 in a concentration of 330-480 g/L;
NiCl2 in a concentration of 45-80 g/L;
boric acid in a concentration of 35-60 g/L; and
lauryl sulfate in a concentration of 0.2-0.5 g/L.

9. The method of claim 8, wherein the electroplating solution is heated to a temperature between 50° C. and 85° C.

10. The method of claim 9, wherein a voltage between the metal substrate and an anode is not more than 5.5 V and not less than 2.5 V.

11. The method of claim 1, wherein the oxide scale of the metal substrate is comprised primarily of magnetite and hematite.

12. The method of claim 11, wherein, within the oxide scale, a compositional percentage of magnetite is greater than a compositional percentage of hematite.

13. The method of claim 1, wherein the metal substrate undergoes hot rolling prior to the step of providing the electroplating solution.

14. A method for electroplating, the method comprising:
providing a steel substrate, the steel substrate having a surface layer comprising an oxide scale;
providing an electroplating solution at the steel substrate; and
electroplating the surface layer with the electroplating solution,
wherein the oxide scale is formed prior to the step of providing the electroplating solution,
wherein the oxide scale is formed by thermal oxidation of the steel substrate,
wherein the oxide scale varies in thickness from 8.49 μm to 13.7 μm and includes magnetite, and wherein the steel substrate has a chemical composition comprising
carbon in a surface weight percentage of 0.26-0.32,
manganese in a surface weight percentage of 0.41-1.04,
sulfur in a surface weight percentage of 0.003-0.004,
phosphorus in a surface weight percentage of 0.008-0.011,
silicon in a surface weight percentage of 0.19-0.38,
nickel in a surface weight percentage of 0.46-0.08,
chromium in a surface weight percentage of 0.19-1.11,
molybdenum in a surface weight percentage of 0.02-0.79,
vanadium in a surface weight percentage of 0.002-0.004,
copper in a surface weight percentage of 0.06-0.11,
tin in a surface weight percentage of 0.004-0.009,
aluminum in a surface weight percentage of 0.006-0.042, titanium in a surface weight percentage of 0.003-0.012, and an iron balance.

15. The method of claim 14, wherein the chemical composition of the steel substrate further comprises 20-22 ppm of calcium.

16. The method of claim 15, wherein the oxide scale of the metal substrate is comprised primarily of magnetite and hematite.

17. The method of claim 16, wherein, within the oxide scale, a compositional percentage of magnetite is greater than a compositional percentage of hematite.

18. The method of claim 17, wherein the metal substrate undergoes hot rolling prior to the step of providing the electroplating solution.

* * * * *